US005431460A

United States Patent [19]

Hass et al.

[11] Patent Number: 5,431,460

[45] Date of Patent: Jul. 11, 1995

[54] HOOD RELEASE LATCH MECHANISM INCLUDING SPRING CLUTCH MEANS

[75] Inventors: Tave Hass; Wayne L. Soucie, both of Columbia; Robert L. Heimann, Moberly, all of Mo.

[73] Assignee: Orscheln Co., Moberly, Mo.

[21] Appl. No.: 206,148

[22] Filed: Mar. 7, 1994

[51] Int. Cl.[6] ..... E05C 3/16

[52] U.S. Cl. ..... 292/216; 292/DIG. 14; 292/DIG. 61

[58] Field of Search ..... 292/216, DIG. 14, 341.17, 292/DIG. 61, DIG. 43

[56] References Cited

U.S. PATENT DOCUMENTS

| | | | |
|---|---|---|---|
| Re. 25,229 | 8/1962 | Sacchini et al. . | |
| 3,236,121 | 2/1966 | Gdowik et al. . | |
| 3,347,584 | 10/1967 | Johnstone . | |
| 3,355,207 | 11/1967 | Newman . | |
| 3,405,791 | 10/1968 | Kaplan . | |
| 3,966,242 | 6/1976 | Vitalis . | |
| 4,455,042 | 6/1984 | Yamada | 292/216 X |
| 4,612,823 | 9/1986 | DeLeeuw et al. . | |
| 4,612,823 | 7/1989 | Haas et al. . | |
| 5,010,983 | 4/1991 | Kitamura . | |
| 5,066,055 | 1/1991 | Saitoh et al. . | |
| 5,182,963 | 2/1993 | Perisho . | |

FOREIGN PATENT DOCUMENTS 3819346 12/1989 Germany .

*Primary Examiner*—Rodney M. Lindsey
*Attorney, Agent, or Firm*—Laubscher & Laubscher

[57] ABSTRACT

A latching mechanism includes a latch member pivotally connected with a mounting bracket for movement between latched and released positions, together with a spring clutch device that normally permits pivotal movement of the latch member toward the latched position. The latch member includes a cam surface that is operable by a striker member to displace the latch member from the released position to the latched position as the striker member is displaced toward the mounting bracket (for example, during the closure movement of a hood component to which the striker member is attached). A release device serves to operate the spring clutch to a released condition, whereupon the latch member is spring-biased toward the released position, thereby to unlock the striker member from the mounting bracket.

7 Claims, 3 Drawing Sheets

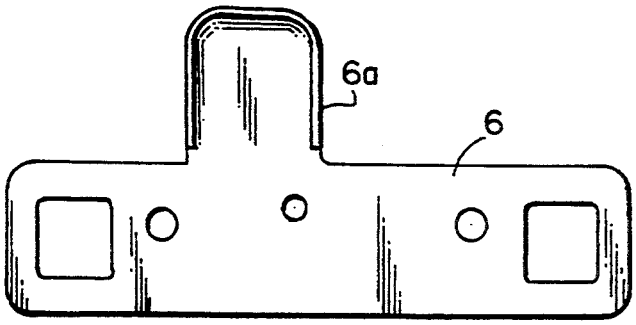
FIG. 6
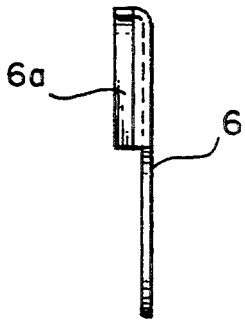
FIG. 7
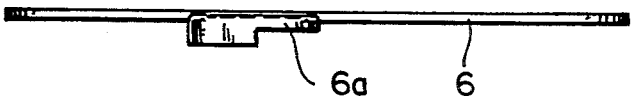
FIG. 8
FIG. 9
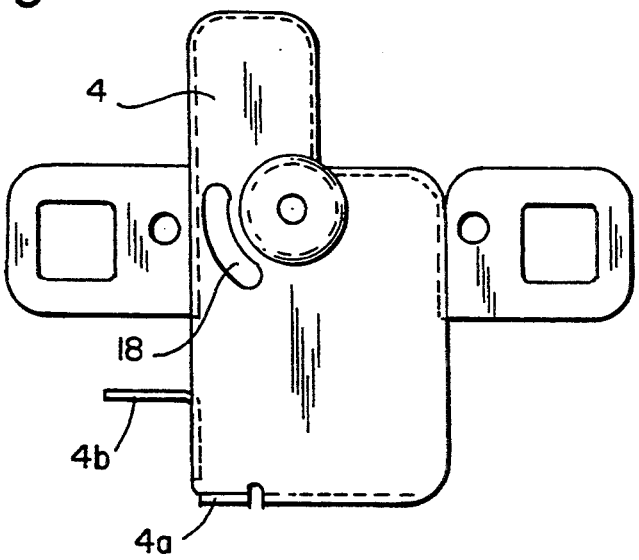
FIG. 10
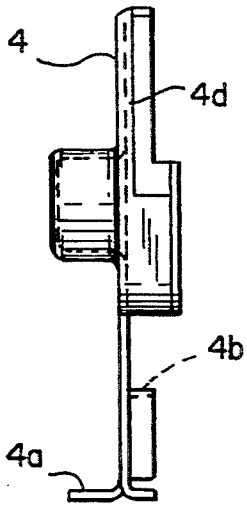
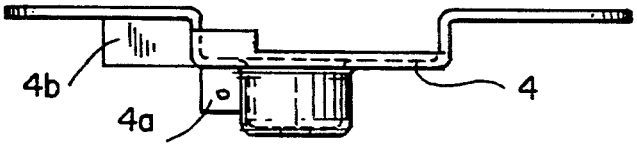
FIG. 11

FIG. 12
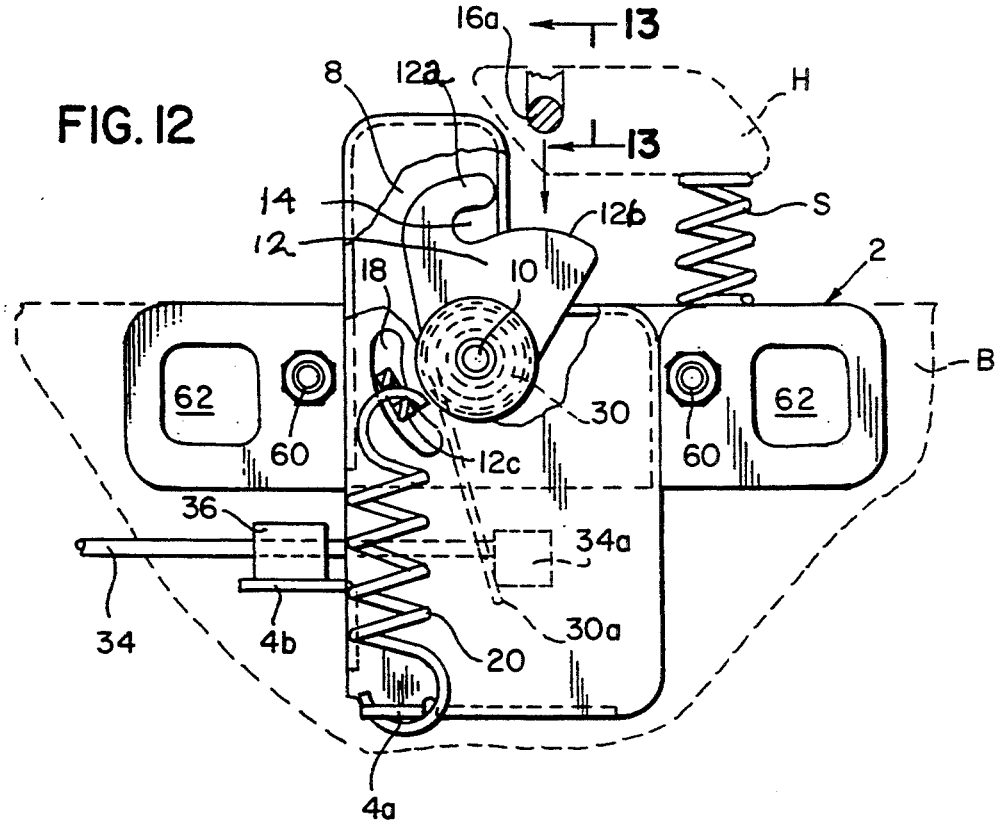
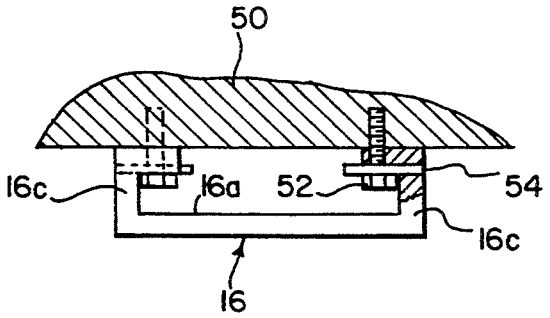
FIG. 13
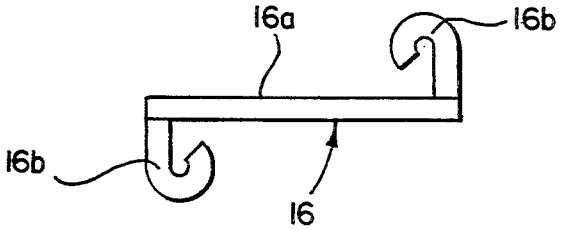
FIG. 14

HOOD RELEASE LATCH MECHANISM INCLUDING SPRING CLUTCH MEANS

STATEMENT OF THE INVENTION

An improved latch mechanism for vehicle hood components or the like includes a latch member pivotally connected with a mounting bracket for displacement between latched and released positions, use being made of spring clutch means which normally permit movement of the latch member in the direction from said released position toward said latched position, but prevent movement of the latch member in the opposite direction. The latch member includes a cam surface operable by a striker member to displace the latch member toward the latched position, thereby to lock the striker member to the mounting bracket.

BRIEF DESCRIPTION OF THE PRIOR ART

Various types of latching devices are well known in the prior art for releasably locking together a pair of relatively movable components. In the automotive field, for example, latching devices are provided for locking the hood and trunk components to the vehicle body or frame. Examples of such locking and latching devices for automotive use are presented in the prior patents to Johnstone U.S. Pat. No. 3,347,584, Newman U.S. Pat. No. 3,355,207, Vitalis U.S. Pat. No. 3,966,242 and Takeshi Saitoh et al U.S. Pat. No. 5,066,055, among others.

In these known latch devices, a latch member is operated by a striker during the closure of one component (such as a hood) relative to another, thereby to lock the components together. The known latching systems contain certain inherent drawbacks. For example, owing to the strong spring force retaining the latch member in the latched position, a relatively high amount of force (on the order of 30 to 45 pounds) must be applied to the hood release cable to force the hood latch back to the hood released position. Often this release force is accompanied by an undesirable relatively long degree of travel of the release cable. Furthermore, if the hood does not come down properly and far enough to completely pivot the latch member to the latched position, the spring-biased hood latch is returned to its fully released position. Finally, owing to the geometry of the conventional latch designs, there is a relatively long moment arm between the hood holder and latch pivot pin, thereby producing a great amount of torque when the hood bumps up and down during road travel.

Spring clutch devices are also known in the patented prior art, as evidenced by the patents to Hass et al U.S. Pat. No. 4,850,242 and Perisho U.S. Pat. No. 5,182,963 (each assigned to the same assignee as the instant invention), Gdowik et al U.S. Pat. No. 3,236,121, Kaplan U.S. Pat. No. 3,405,791, DeLeeuw U.S. Pat. No. 4,612,823, Yoshiharu Kitamura U.S. Pat. No. 5,010,983, and Sacchini et al No. RE 25,229. In these known devices, a helical clutch spring is mounted concentrically about, and in frictional engagement with the peripheral surface of, a clutch drum. Depending on the direction of the turns of the helical clutch spring, under normal conditions rotation of the drum in one direction relative to the spring is permitted, but rotation of the drum in the opposite direction is prevented. When the clutch spring is operated to an expanded or released condition (as by the applying an expanding or separating force to an associated end turn of the clutch spring, for example), the drum is released for free rotation in either direction relative to the clutch spring.

The present invention was developed to provide an improved latching mechanism the operation of which is enhanced by incorporating the spring clutch principles of operation.

SUMMARY OF THE INVENTION

Accordingly, a primary object of the present invention is to provide an improved latching mechanism in which the pivotally movable latch member is connected with its mounting bracket via clutch spring means which normally permit cam-operable movement of the latch member by the striker in the direction from the fully released position toward the fully latched position, but prevent pivotal movement of the latch member in the opposite direction (i.e., toward the released position). Release means serve to operate the spring clutch means to an expanded or released condition, whereupon the latch member is released and is biased by associated latch spring means toward the fully released position, thereby to unlock the striker member on one vehicle component from the mounting bracket on another component.

According to a more specific object of the invention, the clutch spring means includes a clutch drum coaxial with the pivot axis of, and rigidly connected at one end with, the latch member, and an anchor drum arranged colinearly end-to-end with the other end of the clutch drum, said anchor drum being connected at its end remote from the clutch drum with the mounting bracket. A helical clutch spring is mounted concentrically about, and in frictional engagement with, the clutch and anchor drums. The release means cooperate with the end of the clutch spring adjacent the latch member to expand that end of the spring and thereby release the clutch drum and the latch for rotational movement relative to the anchor drum and the bracket. The end of the clutch spring remote from the latch member is connected against movement relative to the mounting bracket, if desired.

Another object of the invention is to provide latch means including spring clutch means and release means operable by an extremely low amount of force on the release end of the clutch spring, and with a low degree of travel of the release cable. Owing to the use of the spring clutch means for controlling the operation of the latch member, the advantage is presented that even if the movable component does not permit the striker member and the associated cam means to pivot the latch member to the fully latched position, the latch projection on the latch member is at full holding power even at partial engagement. Owing to the geometry of the design, there is a relatively short moment arm between the latching projection and the latch pivot pin, thereby allowing only a minimum amount of torsional force when the hood bumps up and down during road travel. Since the clutch spring retaining means are arranged on the same axis as the latch, the number of parts are reduced and an improved assembly process is achieved. Finally, owing to the reduction in parts and weight, a more cost effective design is provided.

BRIEF DESCRIPTION OF THE DRAWINGS

Other objects and advantages of the invention will become apparent from a study of the following specification, when viewed in the light of the accompanying drawings, in which:

FIGS. 6–8 are front elevation, right side elevation, and top plan views of the rear bracket member;

FIGS. 9–11 are front elevation, right side elevation, and top plan views of the front bracket member;

FIG. 12 shows the latch mechanism of FIG. 1 in the fully released condition;

FIG. 13 is a sectional view illustrating the striker member, as taken along line 13—13 of FIG. 12; and FIG. 14 is a bottom plan view of the striker member of FIG. 13.

DETAILED DESCRIPTION

Figures 1, 2, 3, 4, 5:
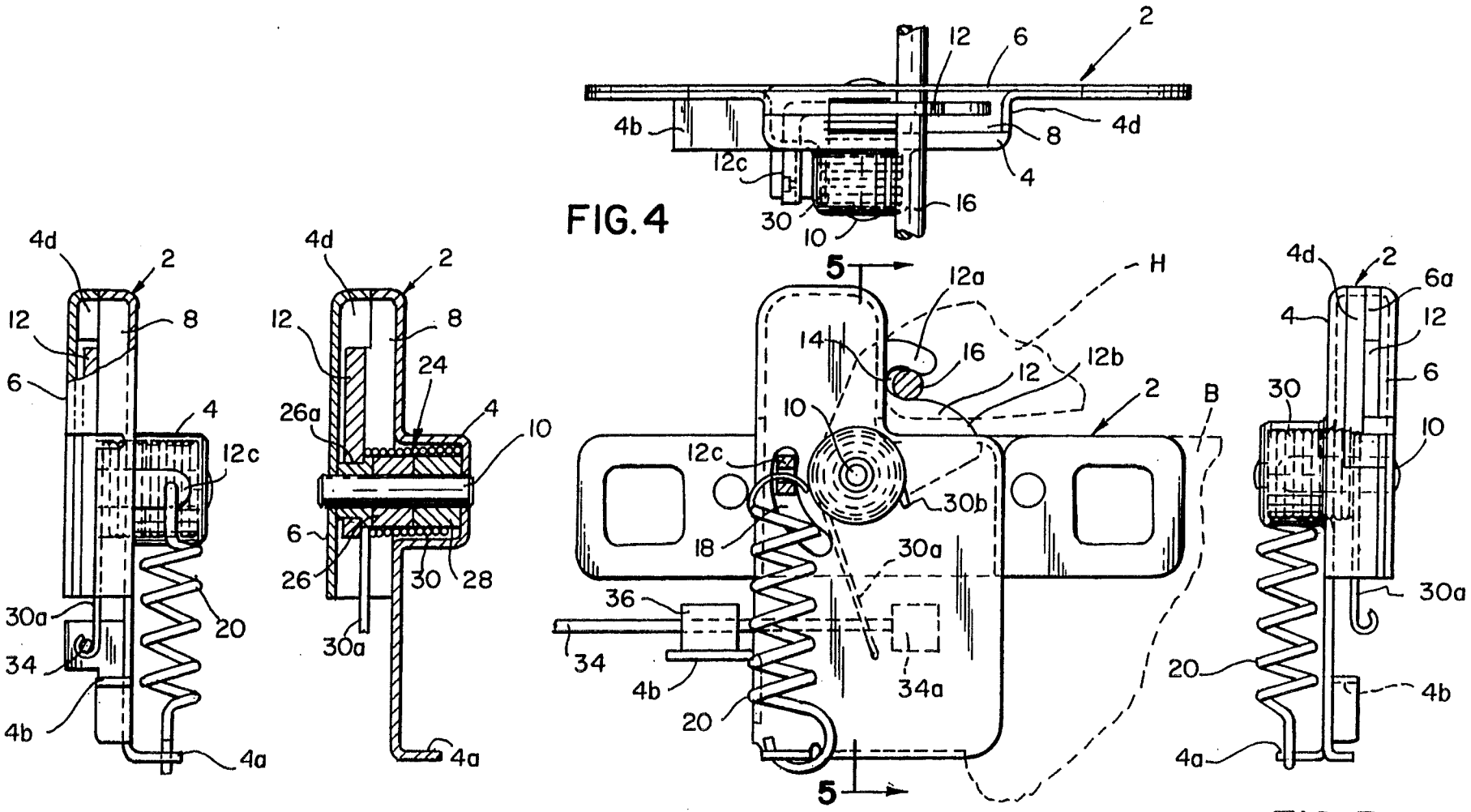
FIG. 1 is a front elevational view of the latch device of the present invention when in the fully latched locking condition.
FIGS. 2–4 are left side elevation, right side elevation, and top plan views, respectively, of the latch mechanism of FIG. 1.
FIG. 5 is a sectional view taken along line 5—5 of FIG. 1.

Referring first more particularly to FIGS. 1–5, the latching mechanism of the present invention includes bracket means 2 formed of front and rear bracket sections 4 and 6 that define an internal chamber 8. Mounted within the chamber 8 for pivotal movement about pivot axis 10 is a latch member 12. As shown in FIG. 1, the latch member 12 includes a latch projection portion 12*a* which defines a locking opening 14 for receiving a striker member 16 when the latch member 12 is in the illustrated fully latched position. The latch member 12 is also provided with a cam surface 12*b* adjacent the locking opening 14, as will be described below. The latch member 12 also includes a projecting portion 12*c* that extends forwardly of the mounting bracket means and outwardly through a slot 18 contained in the front wall 4. Tension spring 20 is connected at its lower end with horizontal projection 4*a* from front wall 4, and at its upper end the spring is connected with the latch projection 12*c*, thereby biasing the latch member from its fully latched position of FIG. 1 in the counter clockwise direction toward the fully released position of FIG. 12.

In accordance with the characterizing feature of the present invention, spring clutch means 24 are provided between the latch member 12 and the mounting bracket means 2, thereby to control the pivotal movement of the latch member 12. More particularly, the spring clutch means include a spring clutch drum 26 that is rotatably mounted on the pivot pin 10, the latch member 12 being non-rotatably connected with the adjacent hub portion 26a of the spring clutch drum 26. Anchor drum 28 is arranged in co-axial end-to-end relation with the clutch drum 26. At its end remote from the clutch drum 26 of, the anchor drum 28 is rigidly secured to the front section 4 of the bracket means 2. Concentrically mounted about the clutch drum 26 and the anchor drum 28 is a helical clutch spring 30 having a plurality of turns in frictional engagement with the outer peripheral surfaces of the clutch drum 26 and anchor drum 28, respectively. At the end adjacent the latch member 12, the end turn of the clutch spring 30 has a tangentially extending linear portion 30*a* that extends downwardly beyond the lower edge of rear section 6 of the mounting bracket 2, as shown in FIGS. 2, 3 and 5. At its other end, the clutch spring includes a linear tangential extension 30*b* that extends outwardly through a corresponding opening contained in the front section 4 of the mounting bracket 2.

The clutch spring 30 has a normal first condition in which the turns of the helical spring are in frictional engagement with the outer peripheral surfaces of the clutch drum 26 and anchor drum 28. In order to expand the end of the clutch spring adjacent latch 12, a release cable 34 is provided that is slidably guided within guide means 36 mounted on lateral flange portion 4b of the front bracket section 4. The release cable 34 is provided at its free extremity with an enlarged portion 34*a* arranged to extend in spaced relation slightly beyond spring leg 30*a*, as shown in FIG. 1. Thus, upon retraction of the release cable 34, the enlarged end portion 34*a* engages spring leg 30*a* to displace the same in the clockwise direction in FIGS. 1 and 12, thereby to expand the associated turns of the helical clutch spring that cooperate with the clutch drum 26, whereby the clutch drum 26 and latch member 12 are free for rotation by the biasing force of the latch spring 20. Thus, the latch member 12 pivots between the fully latched position of FIG. 1 (wherein the latch extends through an opening defined by the cut-away portions 4*d* and 6*a* of the bracket sections) and the retracted position shown in FIG. 12, wherein the latch portion 12*a* is protectively concealed within the chamber 8 defined within the bracket means 2.

The striker member 16 includes a first portion 16*a* that extends parallel with the pivot axis 10 of the latch member 12. The striker member is bolted to the hood component 50 of the vehicle by bolts 52 that extend through washers 54 and through loop portions 16*b* formed at the ends of the vertical leg portions 16*c* of the striker member.

Operation

In operation, assume that the latch member 12 is in the fully released position shown in FIG. 12, and that the spring clutch 24 is in its normal first condition with the turns thereof in frictional engagement with the clutch drum 26 and anchor drum 28. As the hood member H (FIG. 12) is lowered in the closed direction relative to the body component B, the hood member H engages the main shock-absorbing spring S, and striker portion 16*a* engages cam surface 12*b* on latch member 12. Latch member 12 is thus caused by the striker member to rotate in the clockwise direction, as permitted by the direction of the turns of the helical clutch spring 30. As the clutch member 12 is pivoted in the clockwise direction toward the fully latched position of FIG. 1, striker portion 16*a* rides upon cam surface 12*b* and eventually is introduced within the locking slot 14 defined by locking projection 12*a* on latch member 12. The striker member is thus maintained in the locked condition of FIG. 1, thereby locking the hood H against displacement relative to the body component B. The mounting bracket 2, which is secured to the body frame B by bolts 60 and alignment lugs 62, supports the thrust of the striker member on the latch member 12, and rigidly locks the hood to the body B of the vehicle. The turns of the helical spring clutch 30 prevent pivotal movement of the latch member 12 from the fully latched position of FIG. 1 toward the fully unlatched position of FIG. 12.

To release the locked components of FIG. 1, the release cable 34 is retracted to displace spring arm 30*a* in the clockwise direction, thereby to expand the turns of the clutch spring associated with the clutch drum 26. Latch member 12 is now pivoted in the counter-clockwise direction by the biasing spring 20, whereupon the main shock absorbing spring S raises the hood relative to the body or frame portion B.

While in accordance with the provisions of the Patent Statutes the preferred form and embodiments of the invention have been illustrated and described, it will be apparent that various changes may be made without deviating from the inventive concepts set forth above.

What is claimed is:

1. Latch apparatus for releasably connecting together a pair of relatively movable components such as the hood and frame components of a motor vehicle, comprising:

(a) a mounting bracket adapted for mounting on one of said components;

(b) a striker member adapted for mounting on the other of said components adjacent said mounting bracket;

(c) a latch member pivotally connected with said mounting bracket for pivotal displacement between latched and released positions relative to said mounting bracket, said striker member being generally parallel with the pivot axis of said latch member;

(d) latch spring means normally biasing said latch member toward said released position;

(e) spring clutch means connected between said latch member and said mounting bracket, said spring clutch means normally having a first condition permitting pivotal movement of said latch member in the direction from said released position toward said latched position while simultaneously preventing pivotal movement of said latch member in the opposite direction, said clutch spring means including:

(1) a cylindrical clutch drum connected at one end with said latch member, said clutch drum having a longitudinal axis parallel with said latch member pivot axis;

(2) a helical clutch spring arranged concentrically about said clutch drum and including a plurality of helical turns normally biased radially inwardly into frictional engagement with the periphery of said drum, said turns extending in a direction to permit pivotal movement of said latch member toward said latched position, but to prevent movement of said latch member in the opposite direction toward said released position, said clutch spring having a pair of ends; and (3) means connecting a first one of said clutch spring ends with said mounting bracket;

(f) cam means operable by said striker member during movement thereof toward said mounting bracket when said latch member is in said released position and said spring clutch means is in said normal first condition for pivoting said latch member toward said latched position, said latch member containing a locking recess for receiving said striker member when said latch member is in the fully latched position, thereby to lock said striker member to said mounting bracket; and (g) release means cooperating with the other end of said clutch spring for operating said spring clutch means from said first condition to a released condition in which said clutch drum and said latch member are released for pivotal displacement by said latch spring means toward said released position, thereby to unlock said striker member from said mounting bracket.

2. Apparatus as defined in claim 1, and further including first fastening means for fastening said mounting bracket to one component of the vehicle, and second fastening means for fastening said striker member to the other vehicle component.

3. Apparatus as defined in claim 1, wherein said release means comprises means for expanding the turns of said helical clutch spring relative to said clutch drum, thereby to release said clutch drum and said latch member for pivotal movement in the direction from said latched position toward said released position.

4. Apparatus as defined in claim 3, wherein said means for connecting said clutch spring first end with said mounting bracket includes an anchor drum colinearly arranged end-to-end relative to said clutch drum, the end of said anchor drum remote from said clutch drum being non-rotationally connected with said mounting bracket, said helical clutch spring first end being concentrically arranged about, and in continuous frictional engagement with the peripheral surface of, said anchor drum.

5. Apparatus as defined in claim 4, wherein said clutch spring other end includes a generally tangentially extending linear end extension; and further wherein said release means includes means for displacing said end extension in a direction to expand the adjacent clutch spring turns.

6. Apparatus as defined in claim 1, wherein said latch member contains a cam surface defining said cam means.

7. Apparatus as defined in claim 6, wherein said latch member includes a catch projection adjacent said cam surface, said catch projection defining said locking recess and being so arranged that said striker member enters said locking recess when said latch member is pivoted to the fully latched position.

* * * * *